US007633466B2

(12) United States Patent
Hsu et al.

(10) Patent No.: US 7,633,466 B2
(45) Date of Patent: Dec. 15, 2009

(54) APPARATUS AND METHOD FOR LUMINANCE ADJUSTMENT OF PLASMA DISPLAY PANEL

(75) Inventors: Chao-Hung Hsu, Taichung County (TW); Wei-Chi Lai, Taoyuan County (TW)

(73) Assignee: Chungwa Picture Tubes, Ltd., Taoyuan (TW)

( * ) Notice: Subject to any disclaimer, the term of this patent is extended or adjusted under 35 U.S.C. 154(b) by 628 days.

(21) Appl. No.: 11/164,326

(22) Filed: Nov. 18, 2005

(65) Prior Publication Data

US 2007/0115213 A1 May 24, 2007

(51) Int. Cl.
*G09G 3/28* (2006.01)

(52) U.S. Cl. ..... 345/60; 345/63; 345/690

(58) Field of Classification Search ..... 345/63, 345/60, 37, 690, 212, 61
See application file for complete search history.

(56) References Cited

U.S. PATENT DOCUMENTS 5,757,343 A * 5/1998 Nagakubo ..... 345/63
6,380,943 B1 * 4/2002 Morita et al. ..... 345/589
6,794,824 B2 9/2004 Song et al. ..... 315/169.4
2001/0006378 A1 * 7/2001 Kasahara et al. ..... 345/60
2002/0126139 A1 * 9/2002 Kuriyama et al. ..... 345/690
2002/0140640 A1 * 10/2002 Watanabe ..... 345/63
2003/0058476 A1 3/2003 Kwon et al. ..... 358/3.02
2003/0173903 A1 * 9/2003 Takeuchi et al. ..... 315/169.2
2004/0008216 A1 * 1/2004 Onozawa et al. ..... 345/690
2004/0183755 A1 9/2004 Kim ..... 345/63
2004/0212565 A1 * 10/2004 Ide ..... 345/60

FOREIGN PATENT DOCUMENTS

CN 1424706 6/2003

* cited by examiner

*Primary Examiner*—Amare Mengistu
*Assistant Examiner*—Koosha Sharifi
(74) *Attorney, Agent, or Firm*—Jianq Chyun IP Office

(57) ABSTRACT

A luminance adjustment apparatus for a plasma display panel (PDP) is proposed. The luminance adjustment apparatus includes a luminance controller, a gray level shifter and a power controller. The luminance controller outputs a gray level shifting signal and a power adjustment signal. The gray level shifter receives a first luminance video signal and the gray level shifting signal, after the first luminance video signal being level shifted according to the gray level shifting signal, a gray level shifted video signal is output. The power controller is used to receive the gray level shifted video signal and the power adjustment signal, after the gray level shifted video signal being power adjusted by the power adjustment signal, a sub-field controlling signal is output. This enables the preservation of image gradation when adjusting luminance of a video image.

14 Claims, 6 Drawing Sheets

APPARATUS AND METHOD FOR LUMINANCE ADJUSTMENT OF PLASMA DISPLAY PANEL

BACKGROUND OF THE INVENTION

1. Field of Invention

The present invention relates to apparatus and method of luminance adjustment of plasma display panel. More particularly, the present invention relates to luminance adjustment method on maintaining original image gradation of plasma display panel.

2. Description of Related Art

Current display apparatus can be separated to two categories that one is using cathode ray tube, and another one is flat panel display. Because flat panel display is lighter and thinner than cathode ray tube display, the display has characteristics of no distortion of display image and no magnetic field interference, flat panel display replaces cathode ray tube display gradually and becomes hot product in the display market.

Usual flat panel displays in the market are liquid crystal display and plasma display panel etc. Technical principle of plasma display panel is using ultraviolet ray produced by inert gases in electric discharge to stimulate color fluorescent powder and then converted to visible light which human eye can see. The advantage of plasma display panel compared to liquid crystal display is that the panel can be made to a large size for a display screen, therefore it has a dedicated application market, in addition, plasma display panel has advantages of wider viewing angle and longer lifetime.

In conventional technology, plasma display panel usually uses the adjustment of gray level to adjust luminance as shown in FIG. 1. This conventional technology decreases the gray level under a constant consumption power, and sacrifices gradation of holistic image. In addition, because the power curve remains constant, this prior art still consumes a constant power and cannot timely save power consumption when gray level decreases.

In considering the foregoing descriptions, the present invention provides a solution to maintain gradation of holistic image and increase power use efficiency.

SUMMARY OF THE INVENTION

An object of the present invention is to provide an apparatus and a method for luminance adjustment so that image gradation will not be sacrificed.

Another object of the present invention is to provide an apparatus and a method for luminance adjustment which can reduce consumption power while display luminance is decreasing.

The present invention provides an apparatus of luminance adjustment, suitable for use in a plasma display panel. This apparatus of luminance adjustment includes a luminance controller, a gray level shifter, and a power controller. The luminance controller is used to output a gray level shifting signal and a power adjustment signal. The gray level shifter is used to receive a first luminance video signal and the gray level shifting signal. After the first luminance video signal is adjusted on level shift, according to the gray level shifting signal, a gray level shifted video signal is outputted. The power controller is used to receive the gray level shifted video signal and the power adjustment signal. After the gray level shifted video signal is adjusted in power according to the power adjustment signal, a sub-field controlling signal is outputted.

According to a preferred embodiment of this invention, the shifting adjustment of the first luminance video signal based on the gray level shifted signal is a linear shifting adjustment.

According to a preferred embodiment of this invention, the shifting adjustment of the first luminance video signal based on the gray level shifted signal is a non-linear shifting adjustment.

According to a preferred embodiment of this invention, the power adjustment of the gray level shifted signal based on the power adjustment signal is used to adjust the power consumption to achieve the luminance adjustment.

According to another preferred embodiment of this invention, the power adjustment of the gray level shifting signal based on the power adjustment signal is used to implement the luminance adjustment by the adjusting a sustain pulse frequency.

According to another embodiment of this invention, the power controller includes a display ratio shifter and an automatic power controller. The display ratio shifter is used to receive the power adjustment signal and convert this signal to a display ratio shifting signal. The automatic power controller is coupled to the display ratio shifter to receive a first luminance video signal, and uses the display ratio shifting signal to adjust the power consumption and luminance while displaying the received first luminance video signal, and output a sub-filed controller signal.

According to foregoing embodiment, the automatic power controller in the embodiment decides the sustain pulse frequency of the image displaying based on the received display ratio shifting signal. During displaying, the higher the sustain pulse frequency is, the higher the corresponding power is.

According to foregoing embodiment, the automatic power controller in the embodiment decides the sustain pulse frequency of the image displaying based on the received display ratio shifting signal. When the sustain pulse frequency keeps the same, during displaying, the higher the display ratio is, the higher the corresponding power is.

According to further another embodiment, the invention further includes a sub-field processor and a plasma display module. The sub-field processor is coupled to the plasma display module, and receives the signal, which has been adjusted in luminance (power), to control the luminance display of the plasma display module.

According to another embodiment, the invention further includes a sensor coupled to the luminance controller, and a luminance control signal of the luminance controller is automatically controlled according to an environment luminance.

The invention provides a method of luminance adjustment, suitable for use in a plasma display panel. The method of luminance adjustment includes the following steps. First, a first luminance video signal and a gray level shifting signal are received. After the first luminance video signal is adjusted on linear shift or non-linear shift according to the gray level shifting signal, a video gray level shifting signal is outputted. Then, the power adjustment signal and the video gray level shifting signal are received. After the video gray level shifting signal is adjusted on power according to the power adjustment signal, the sub-field controlling signal and the sustain pulse frequency, which have been adjusted, are outputted.

According to an embodiment, the power adjustment of the video gray level shifting signal according to the power adjustment signal is adjusting the power consumption to achieve the luminance adjustment.

According to another embodiment, the power adjustment of the video gray level shifting signal according to the power adjustment signal is adjusting the sustain pulse frequency to achieve the luminance adjustment.

According to further another embodiment, the power adjustment signal can be adjusted by a manual adjustment or automatically adjusted by sensing the environment luminance.

Since the invention take the manner of changing he power curve, so that there is no significant change of the gray level range of the image gradation on luminance adjustment. Therefore, the image luminance can be adjusted while the gradation of image remains. When the power consumption of the displayer is at lower luminance, the power consumption is reduced, so as to meet the purpose of power saving.

In order to the make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The features of the embodiment for the invention will be explained by reference of drawings. The spirit and scope of this invention are not limit to these embodiments for explanation. It should be noticed that these drawings cannot be looked as a dedicated size or scale. In the scope of this invention, any structure and material described in the following text can be modified properly.

Figure 1:
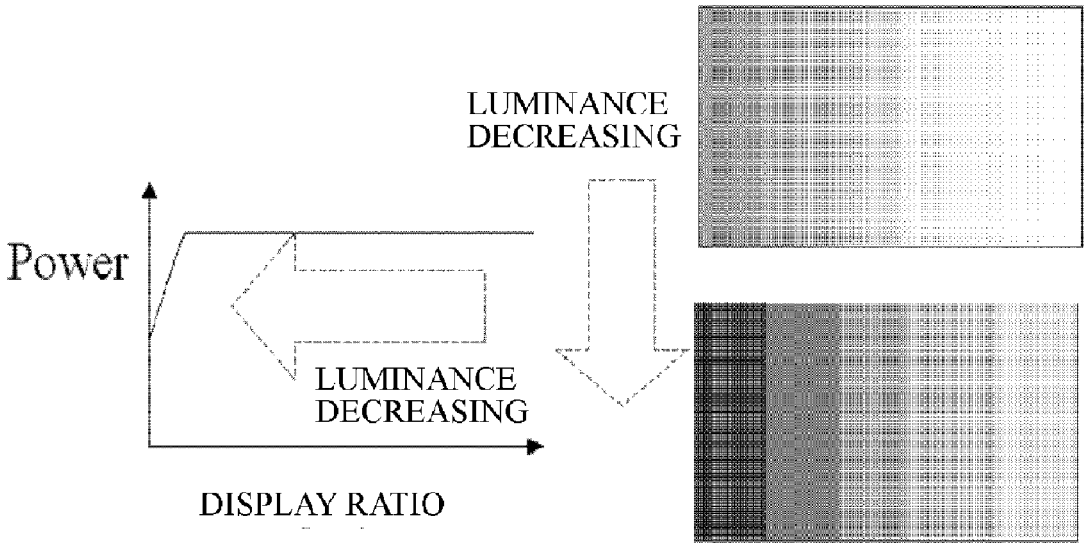
FIG. 1 (PRIOR ART)
FIG. 1 is a drawing, schematically illustrating a conventional method of luminance adjustment in plasma display panel.
Figure 2:
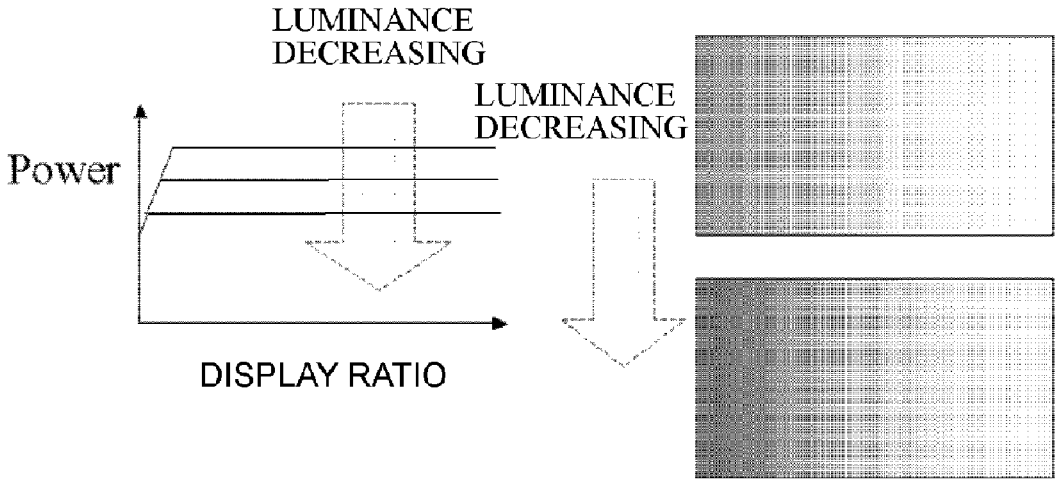
FIG. 2 is a drawing, schematically illustrating a method of luminance adjustment in plasma display panel, according to an embodiment of the invention.

As shown in FIG. 2, the invention designs a function of luminance adjustment, so that the image gradation can remain when the plasma display panel is under luminance adjustment, and the power consumption can be reduced when the luminance is adjusted down. The difference with prior art is changing the curve between the power to the display ratio. That is, when the luminance is adjusted down, the curve of the power to the display ratio is modified to low power consumption. Likewise, when the luminance is adjusted up, the curve of the power to the display ratio is modified to high power consumption. Therefore, the luminance adjustment accompanies with changing of power consumption, and this is not the conventional way by simply changing the gray level range.

Figure 3:
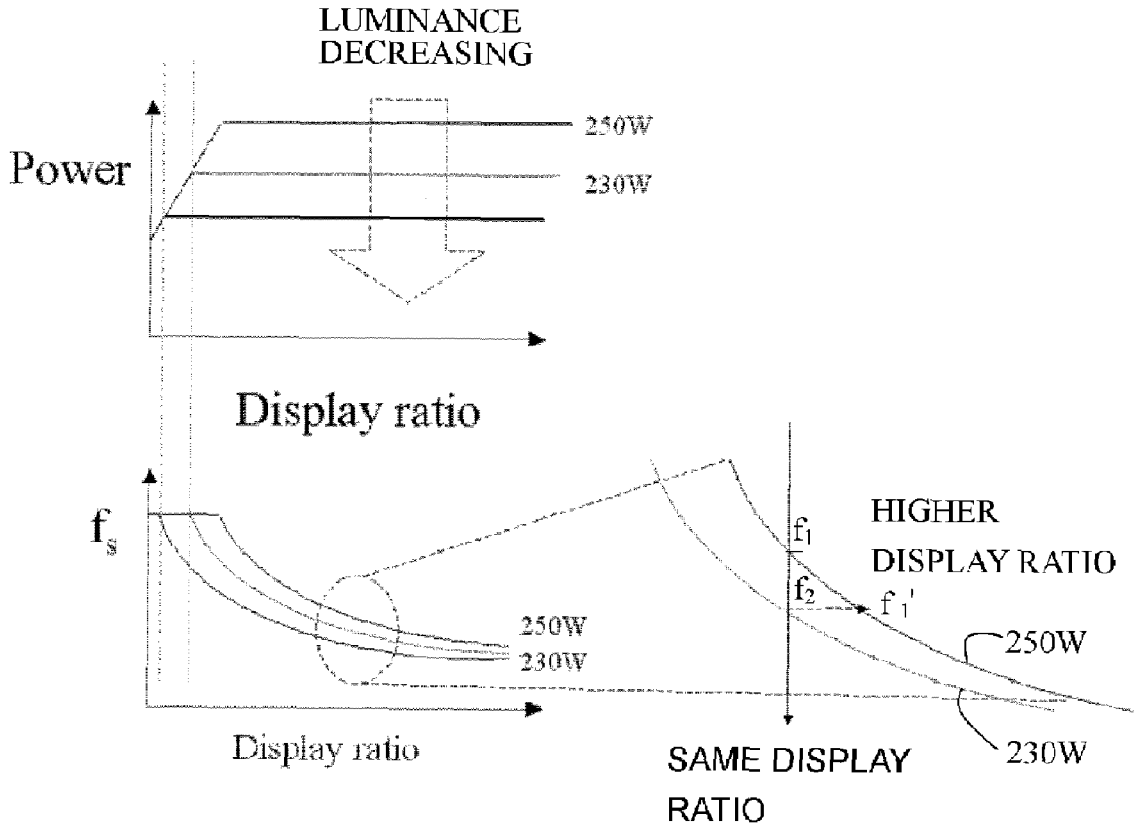
FIG. 3 is a drawing, schematically illustrating the principle of luminance adjustment of the invention.

FIG. 3 is a drawing, schematically illustrating the principle of application of luminance adjustment, according to a preferred embodiment of the invention. According to the power adjustment, the method adjust the display ratio of the image itself for achieving the luminance adjustment. The FIG. 3 uses the curve for a sustain pulse frequency fs by 250 watt and 230 watt to the display ratio for descriptions, so as to adjust the sustain pulse frequency fs or the display ratio in finer adjustment, so as to achieve the effect of luminance adjustment.

As shown in FIG. 3, when the power consumption is adjusted from 250 watt to 230 watt, under the same display ratio, the sustain pulse frequency $f_1$ at 250 watt is higher than the sustain pulse frequency $f_2$ at 230 watt. That is, a sustain pulse frequency $f_1'$ can be obtained from the sustain pulse frequency at 230 watt, lower than the sustain pulse frequency at 250 watt when the display ratio for the same image is intended to be the same. In addition, for the same image, FIG. 3 shows the phenomenon, under the condition of the same sustain pulse frequency, in which the display ratio for the power curve at 250 watt is higher than the display ratio for the power curve at 230 watt. Therefore, the invention can increase image luminance and keep original gray level while the luminance is enhanced and the power consumption is increased.

From the foregoing descriptions, during luminance adjustment, the sustain pulse frequency fs can be used as a base for adjusting the power consumption, so as to keep the image quality at different luminance when the luminance is adjusted.

Referring to FIG. 3, taking adjusting the sustain pulse frequency fs as the example, under same display ratio, the consumption power decreases from 250 watt to 230 watt when the sustain pulse frequency is changed from $f_1$ to $f_2$, so that the power can be saved. Taking adjusting the consumption power as the example, if the power consumption increases from 230 watt to 250 watt when the sustain pulse frequency keeps at $f_2$, the display ratio relatively increases, so that the original image luminance is increased.

Figure 4:
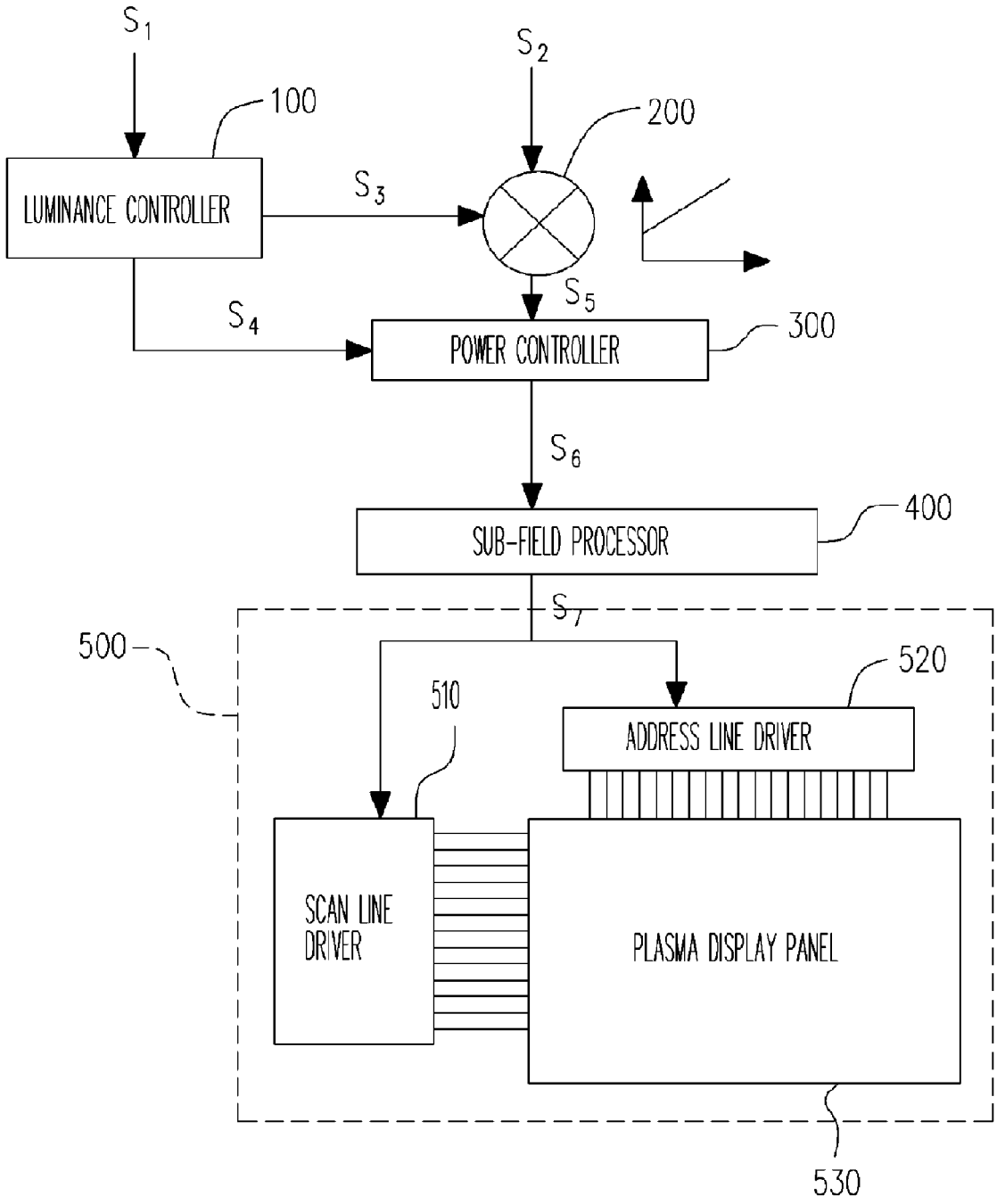
FIG. 4 is a block diagram, schematically illustrating the apparatus of luminance adjustment.

FIG. 4 is a schematic block diagram of luminance adjustment device, wherein the gray level luminance processing mechanism of a typical embodiment of this invention is illustrated in this figure.

In FIG. 4, this luminance adjustment device includes a luminance controller 100, a gray level shifter 200, a power controller 300, a sub-field processor 400 and a plasma display module 500.

First, the luminance controller 100 receives an external control signal $S_1$. At the mean time, a first luminance video signal $S_2$ is input to the gray level shifter 200, and the luminance controller 100 outputs a gray level shifting signal $S_3$ and a power adjustment signal $S_4$. Later, the gray level shifting signal $S_3$ is input to the gray level shifter 200, and it causes a video gray level shifted signal $S_5$ is output after the first luminance video signal $S_2$ is adjusted via linear or non-linear shifting adjustment. The video gray level shifted signal $S_5$ and the power adjustment signal S4 are input to the power controller 300, and after the video gray level shifted signal $S_5$ is adjusted according to the power adjustment signal $S_4$, a sub-field controlling signal $S_6$ is generated and is received by the sub-field processor 400. And then, a scanning information signal $S_7$, needed for driving the plasma display module 500, is generated.

Internal components of the plasma display module 500 include a scan line driver 510, an address line driver 520 and a plasma display panel 530, wherein the scan line driver 510 and the address line driver 520 are used to drive each pixel unit circuit inside the plasma display panel 530.

Figure 5:
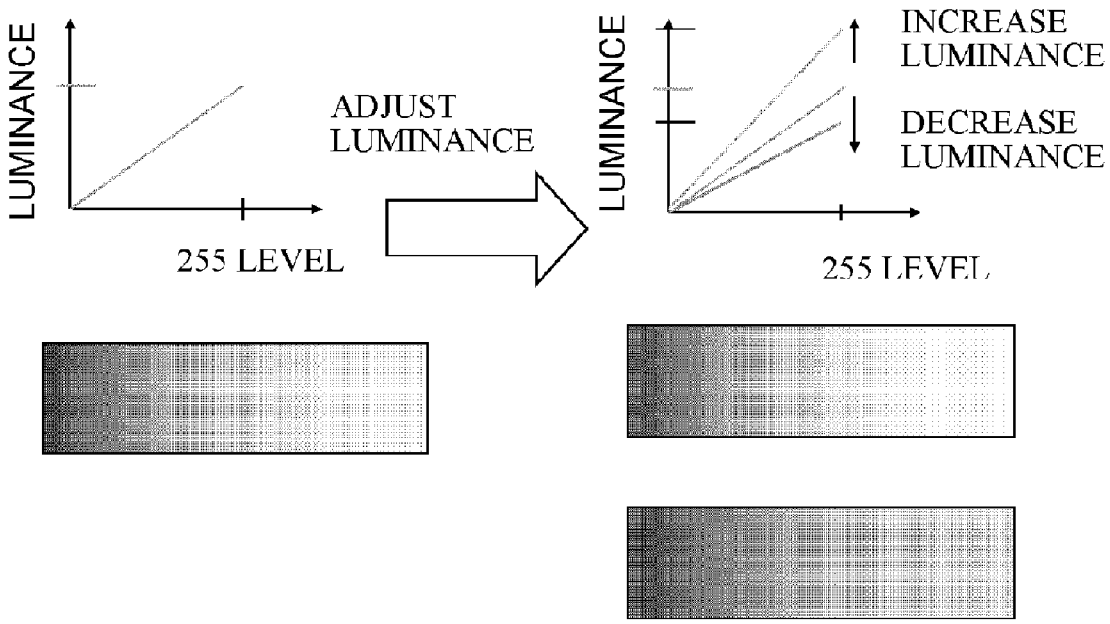
FIG. 5 is a drawing, schematically illustrating the adjustment between the luminance and the gray level slope.

Aforesaid control signal $S_1$ can be used for luminance adjustment by manual operation or this signal can automatically change by environment luminance detected by a sensor. For example, in a preferred embodiment, user can adjust a slope for the luminance to gray level according to user's preference via a manual adjustment mode. As illustrated at FIG. 5, within a certain gray level of, for example, 255 steps in this drawing, the slope of the luminance to the gray level slope is adjusted. The slope is increased when the luminance is adjusted up, and the slope is decreased when the luminance is adjusted down.

For example, in another preferred embodiment, if a sensor (not shown in drawing) is coupled to the luminance controller 100, in the condition that the sensor itself can be used to sense an environment luminance, under the automatic operation mode, the effect to keep the same image quality can also be obtained by the operation of changing the foregoing slope of the luminance to the gray level.

Figure 6:
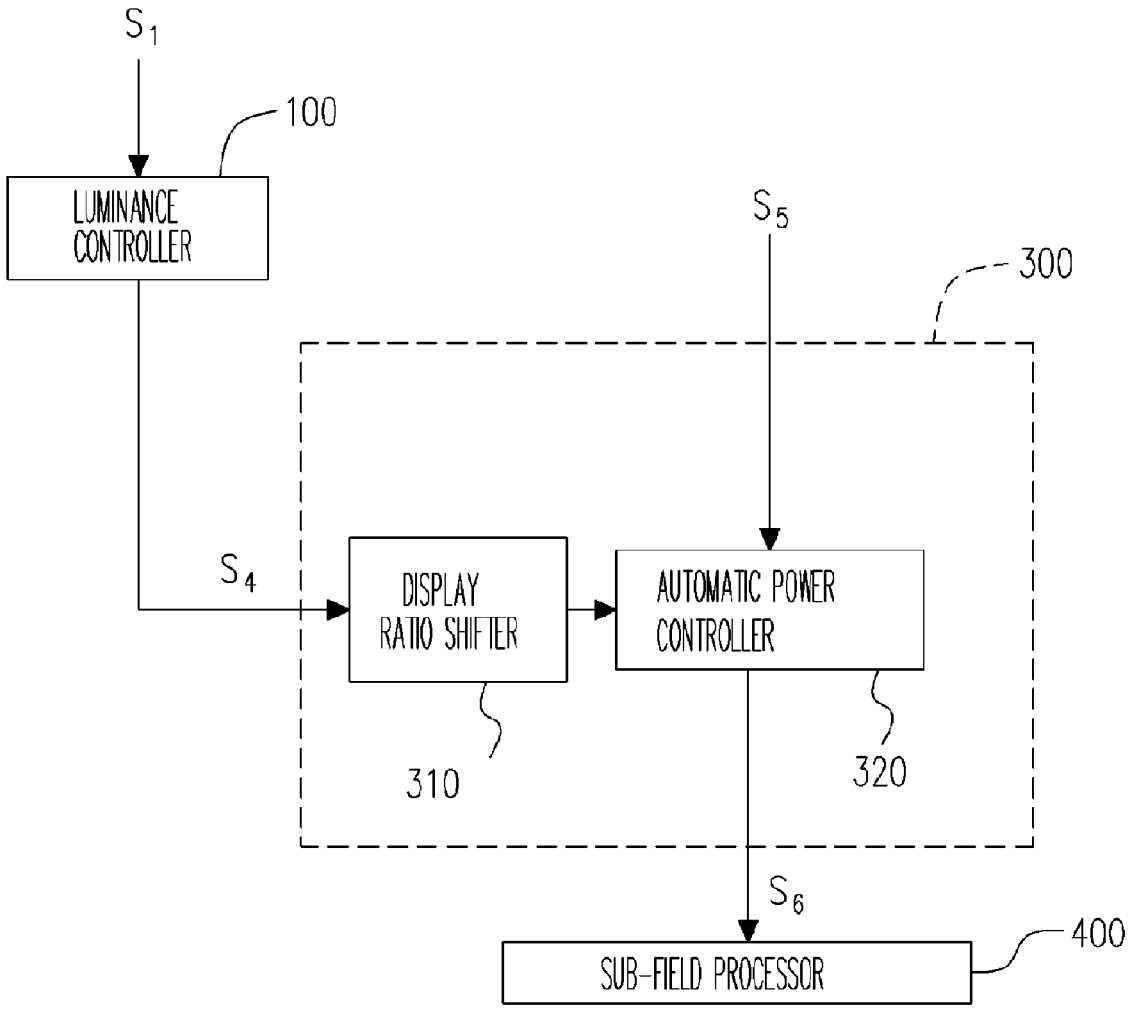
FIG. 6 is a block diagram, schematically illustrating the internal structure of the power controller 300.

FIG. 6 is a block diagram of internal components inside power controller 300 and connection with peripherals. The power controller 300 includes a display ratio shifter 310 and an automatic power controller 320.

The display ratio shifter 310 receives the power adjustment signal $S_4$ from the luminance controller 100, and then the curve of the power to the display ratio is shifted, according to the power adjustment signal $S_4$. And, this information is input to the automatic power controller 320. The automatic power controller 320 converts the video gray level shifted signal $S_5$ to a sub-field controlling signal $S_6$, and inputs the signal $S_6$, to the sub-field processor 400.

Figure 7:
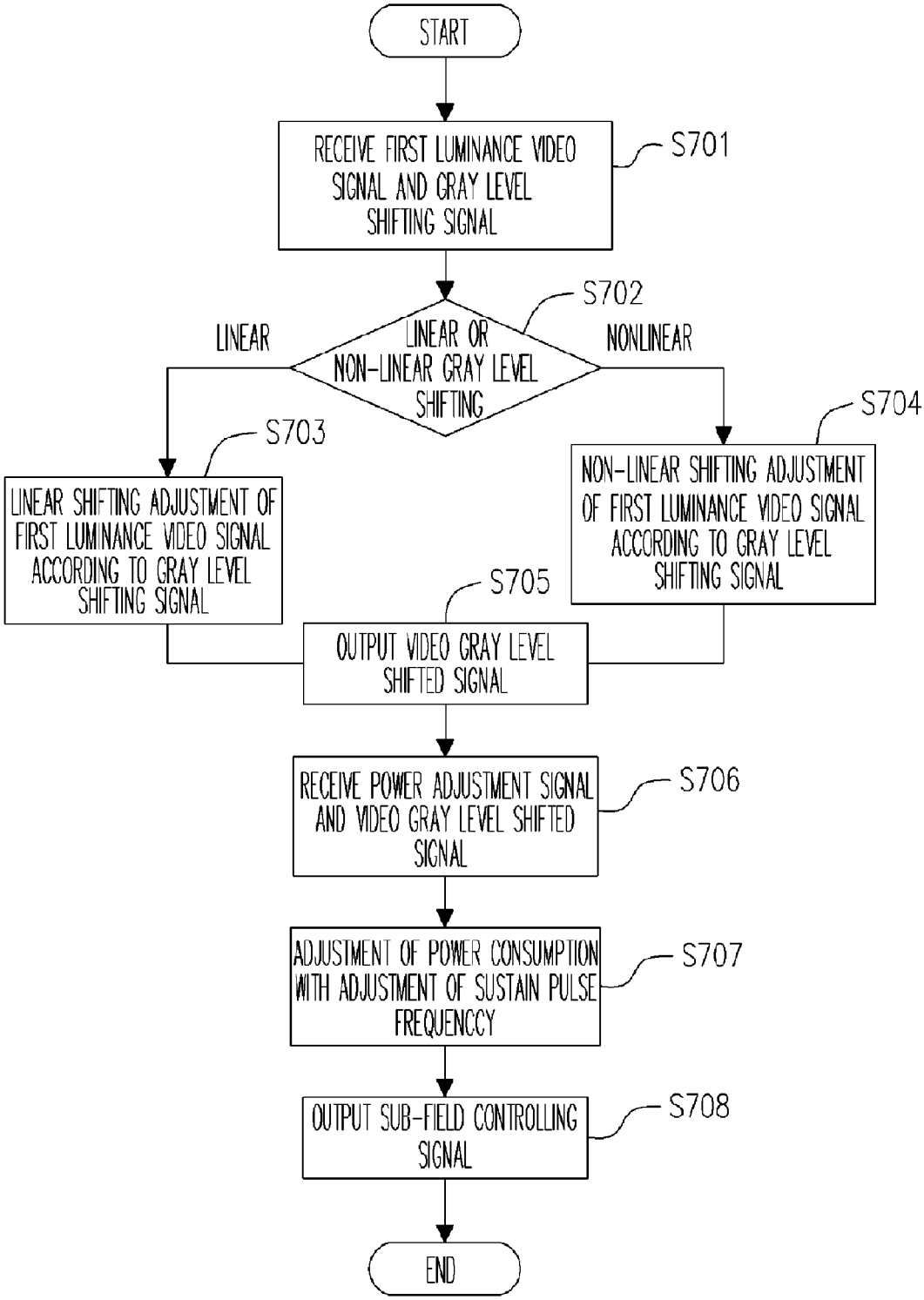
FIG. 7 is a flow diagram, schematically illustrating the process of luminance adjustment.

FIG. 7 illustrates the process procedure of the luminance control method according to a preferred embodiment of this invention. At first, the first luminance video signal and the gray level shifting signal are received in step S701, then it is judged whether or not the gray level shifting adjustment is done by linear or non-linear mode, in step S702. According to the judging result, the first luminance video signal is performed with a linear or a non-linear shifting adjustment, according to the gray level shifting signal, in step S703/S704. And then in step S705, the produced video gray level shifted signal is output. Next in step S706, the power adjustment signal and the video gray level shifted signal are received. Then, the adjustment of power consumption with the adjustment of sustain pulse frequency $f_s$ is proceed to adjust the power, in step 707. Then, the produced sub-field controlling signal is output in step S708.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus of luminance adjustment, suitable for a plasma display panel, the apparatus of luminance adjustment comprising:

a luminance controller, which is used to output a gray level shifting signal and a power adjustment signal;

a gray level shifter, receiving a first luminance video signal and the gray level shifting signal, wherein the first luminance video signal comprises a plurality of gray levels, and after a shifting adjustment on the gray levels of the first luminance video signal according to the gray level shifting signal, outputting a video gray level shifted signal; and a power controller, used to receive the video gray level shifted signal and the power adjustment signal, after a power adjustment on the video gray level shifted signal according to the power adjustment signal, outputting a sub-field controlling signal, wherein the power controller comprises:

a display ratio shifter, which is used to receive the power adjustment signal and shift a curve of a power to a display ratio according to the power adjustment signal so as to obtain a display ratio shifting signal; and an automatic power controller, coupled to the display ratio shifter, for receiving the video gray level shifted signal and using the display ratio shifting signal to adjust a sustain pulse frequency of the received video gray level shifted signal so as to output the sub-field controlling signal.

2. The apparatus of luminance adjustment as claimed in claim 1, wherein the shifting adjustment on the gray levels of the first luminance video signal according to the gray level shifted signal is a linear shifting adjustment.

3. The apparatus of luminance adjustment as claimed in claim 1, wherein the shifted adjustment on the gray levels of the first luminance video signal according to the gray level shifting signal is a non-linear shifting adjustment.

4. The apparatus of luminance adjustment as claimed in claim 1, wherein the power adjustment on the video gray level shifted signal according to the power adjustment signal uses an adjustment of power consumption to have an effect of luminance adjustment.

5. The apparatus of luminance adjustment as claimed in claim 1, wherein, the power adjustment on the video gray level shifted signal according to the power adjustment signal uses an adjustment of sustain pulse frequency to have an effect of luminance adjustment.

6. The apparatus of luminance adjustment as claimed in claim 1, wherein the automatic power controller determines the sustain pulse frequency after the power adjustment according to the received display ratio shifting signal, when a display ratio is the same, and when the sustain pulse frequency is higher, then the corresponding power is higher.

7. The apparatus of luminance adjustment as claimed in claim 1, further comprising a sub-field processor and a plasma display module, wherein the sub-field processor is coupled to the plasma display module, receives the sub-field controlling signal to control a display luminance of the plasma display module.

8. The apparatus of luminance adjustment as claimed in claim 1, further comprising a sensor, wherein the sensor is electrically connected to the luminance controller, and automatically adjusts the luminance controller according to an environment luminance.

9. A method of luminance adjustment, suitable for use in a plasma display panel, the method comprising:

receiving a first luminance video signal and a gray level shifting signal, wherein the first luminance video signal comprises a plurality of gray levels, and after a shifting adjustment on the gray levels of the first luminance video signal according to the gray level shifting signal, outputting a video gray level shifting signal;

receiving a power adjustment signal and shifting a curve of a power to a display ratio according to the power adjustment signal so as to obtain a display ratio shifting signal; and receiving the video gray level shifted signal, and using the display ratio shifting signal to adjust a sustain pulse frequency of the received video gray level shifted signal so as to output a sub-field controlling signal.

10. The method of luminance adjustment as claimed in claim 9, wherein the shifting adjustment on the gray levels of the first luminance video signal according to the gray level shifting signal is a linear shifting adjustment.

11. The method of luminance adjustment as claimed in claim 9, wherein the shifting adjustment on the gray levels of the first luminance video signal according to the gray level shifting signal is a non-linear shifting adjustment.

12. The method of luminance adjustment as claimed in claim 9, wherein the power adjustment signal is based to adjust the power consumption, so as to have an effect of luminance adjustment.

13. The method of luminance adjustment as claimed in claim 9, wherein the power adjustment signal is based to adjust the sustain pulse frequency, so as to have an effect of luminance adjustment.

14. The method of luminance adjustment as claimed in claim 9, wherein the power adjustment signal is automatically adjusted by detection of an environment luminance.

* * * * *